United States Patent [19]

Rusche

[11] 4,384,809

[45] May 24, 1983

[54] MANDREL CLOSURE AND PROCESS FOR IN SITU PILE FORMATION

[76] Inventor: Fredric Rusche, 30303 Beck Rd., Wixom, Mich. 48096

[21] Appl. No.: 171,179

[22] Filed: Jul. 22, 1980

[51] Int. Cl.[3] ..... E02D 5/42

[52] U.S. Cl. ..... 405/240; 405/243

[58] Field of Search ..... 405/233, 236, 238, 239, 405/240, 243, 248, 242

[56] References Cited

U.S. PATENT DOCUMENTS 2,656,684 10/1953 Rios et al. ..... 405/243

3,209,546 10/1965 Lawton ..... 405/238

3,385,070 5/1968 Jackson ..... 405/243

4,158,518 6/1979 Rusche ..... 405/240

*Primary Examiner*—David H. Corbin

*Attorney, Agent, or Firm*—Littlepage & Webner

[57] ABSTRACT

A hollow mandrel has a chute at one side near its top through which concrete is poured, and an open top through which re-inforcing steel is inserted. An expansible closure having an air conduit leading to its lower end is lowered into the mandrel below the chute and expanded, and air is forced into the mandrel while a lifting force is applied to it.

2 Claims, 6 Drawing Figures

MANDREL CLOSURE AND PROCESS FOR IN SITU PILE FORMATION

RELATED APPLICATION

Rusche: Ser. No. 116,995, In situ Pile Forming Method and Apparatus filed Jan. 30, 1980, now U.S. Pat. No. 4,269,544 which is a continuation of Ser. No. 915,456, filed June 14, 1978 now abandoned.

FIELD OF INVENTION

Hydraulic and earth engineering, casting in situ hardenable fluid material, dispensing fluid material while withdrawing dispenser.

PRIOR ART

U.S. Pat. No. 2,656,684 Rios et al.
U.S. Pat. No. 2,822,671 Entz et al.
U.S. Pat. No. 3,303,656 Landau
U.S. Pat. No. 3,707,848 Chelminiski

BACKGROUND AND OBJECTS

In practicing the invention according to my parent application, a hollow mandrel was inserted into a pre-drilled hole. The mandrel had an opening with a chute at one side near its top through which the concrete was poured, and an opening at its top through which re-inforcing steel was inserted. Both the chute and the top opening were closed by power-operated doors so that the interior of the mandrel could be pressurized while a lifting force was applied to it. While that apparatus was successful and a substantial improvement over the prior art, particularly in that it provided for the insertion of re-inforcing steel into the pile being formed, it had a drawback in that cement particles lodged in faces of the door seals and deleteriously effected the pressurization of the interior of the pile and, in addition, permitted blow-out of concrete through the cracks. The object now is to entirely eliminate the doors and the power mechanisms for operating them and to use instead a simple but completely effective device for sealing off the interior of the pile below the chute and, alternatively, for engaging in the top of the mandrel for steadying it while concrete is poured in through the chute.

In accordance with the foregoing objectives, it is intended now to provide an expansible closdure which can be lowered into the upper portion of the mandrel to seal off the mandrel below the chute opening, and a compressed air conduit extending through the closure so as to force air into the mandrel interior. While concrete is poured into the mandrel via the chute, the closure is deflated and withdrawn to above the chute opening and, if desired, the closure can then be expanded in the top of the mandrel and, with the upper end of the closure adjacent a crosstree in the leads, the closure may be used to steady the mandrel. When reinforcing steel is to be inserted, the closure is deflated and lifted away so that the steel can be inserted through the then-open top of the mandrel.

These and other objects will be apparent in the following specification and drawing in which.

Figure 1:
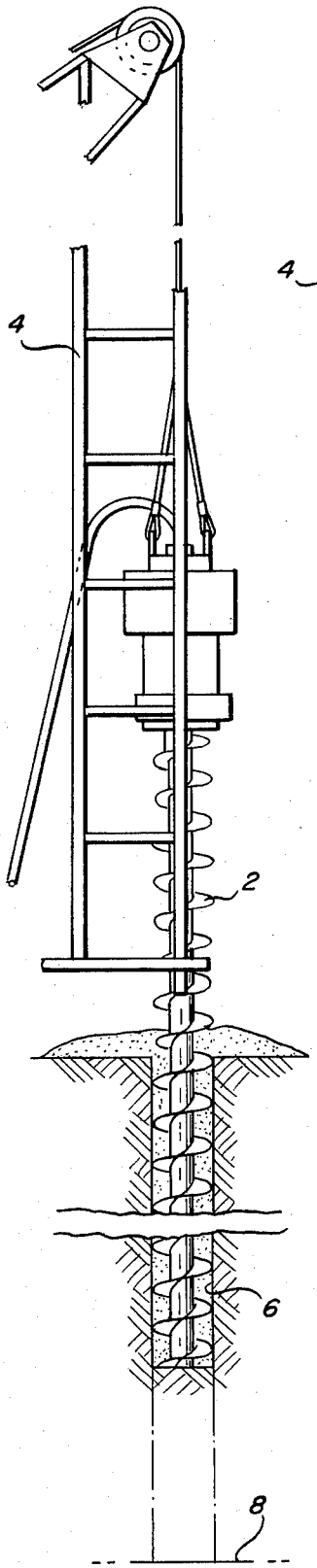
FIG. 1 illustrates the step of pre-drilling a hole into which a pile is to be cast.
Figure 2:
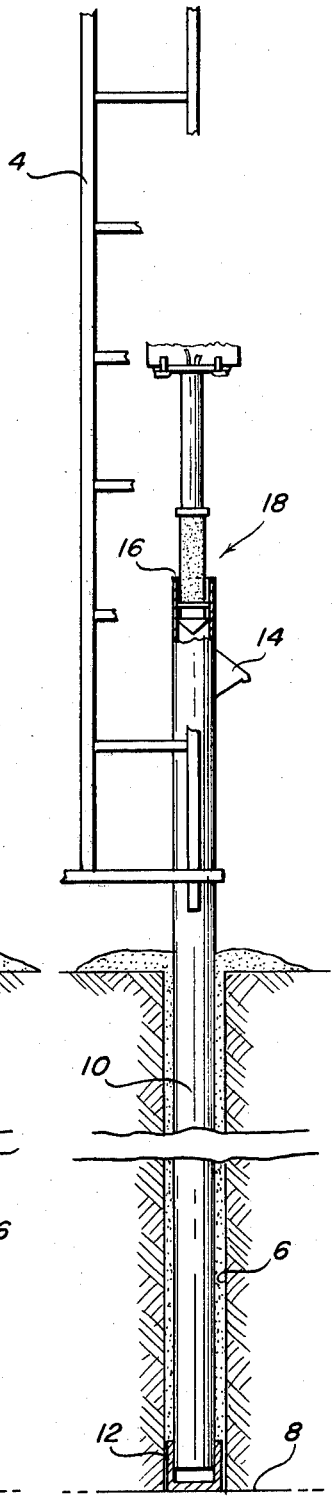
FIG. 2 illustrates the step of inserting the mandrel.
Figure 3:
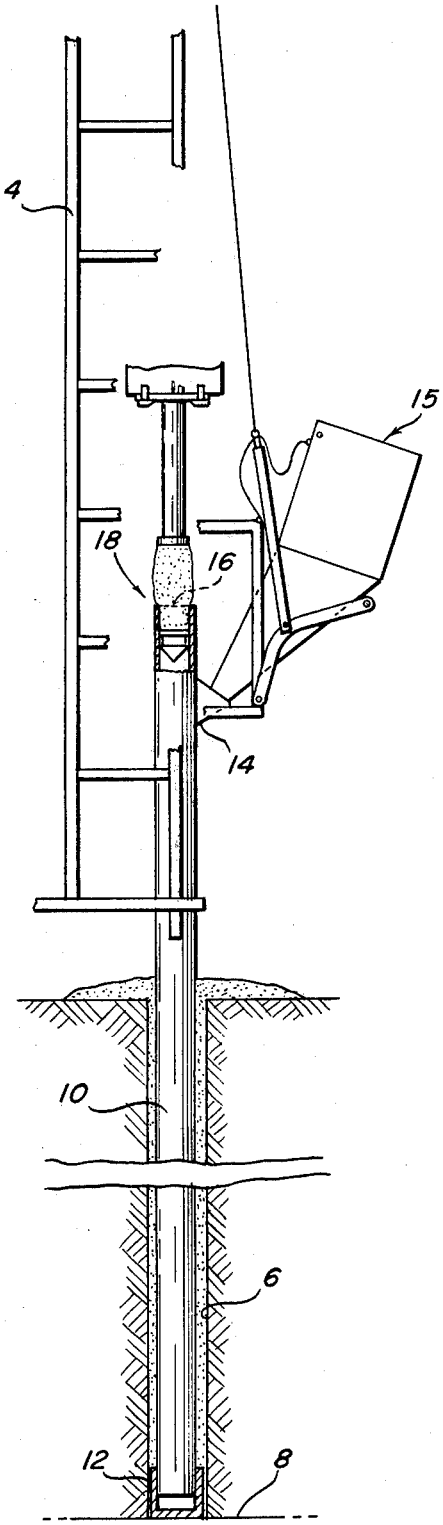
FIG. 3 illustrates the step of pouring concrete into the mandrel via the chute while steadying the top of the mandrel with the closure.

Referring first to FIG. 1 of the drawings, an auger 2 supported in the leads 4 of a pile driving rig is shown drilling a hole 6 in which a pile is to be formed. Conventionally, the hole is augered down to a bearing strata 8, after which the auger is lifted away and a mandrel 10 having a removable overboot 12 is inserted downwardly into the hole. If desired, suitable means may be used for seating the mandrel firmly home in the bearing strata. Thereafter (FIG. 3) concrete is poured into the mandrel via a chute 14 near its upper end by means of a skip assembly 15. It should be noted that the mandrel has an open top 16 into which the closure 18 is engaged so as to steady the mandrel while the concrete is being poured in. The closure 18 and the method in which it is used are the subject matter of this application.

Figure 6:
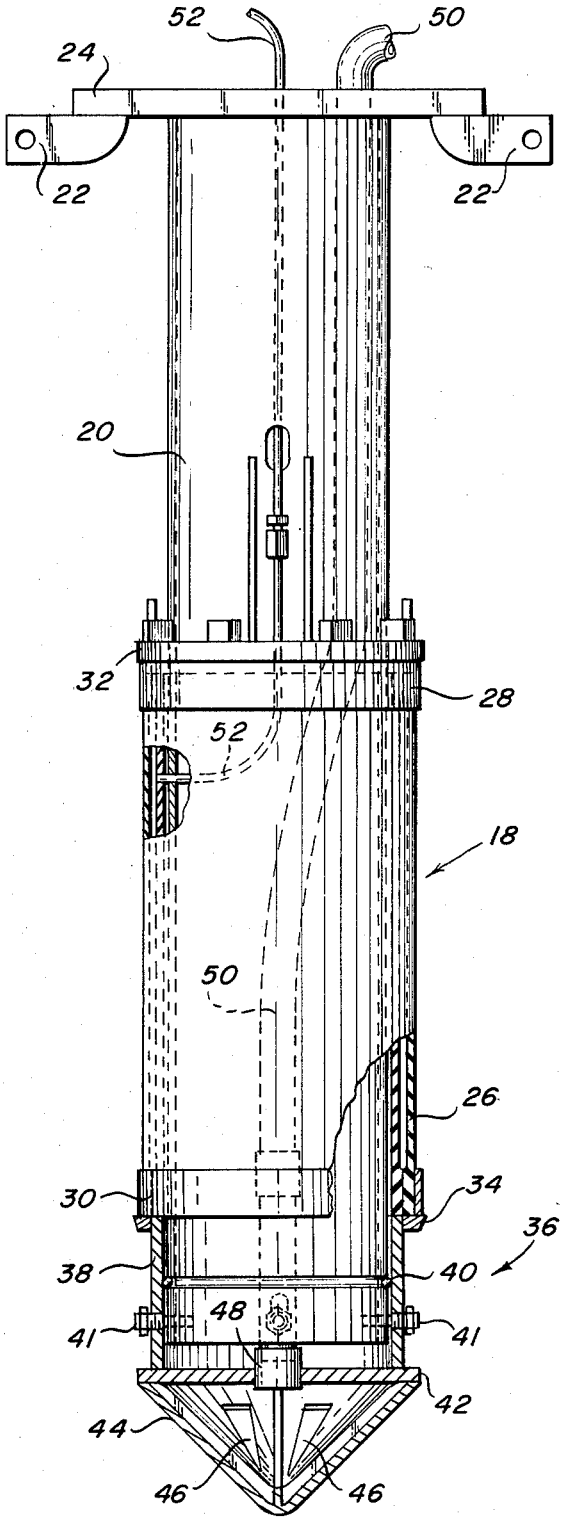
FIG. 6 is a side elevation of the closure, broken away to show the lower part in cross section.

Referring now to FIG. 6 of the drawing for the details of the closure, it consists of an elongate pipe 20 at the upper end of which lifting ears 22 are secured. The ears extend outwardly from a plate 24 welded across the upper end of the pipe. Surrounding the lower portion of the pipe is a double-wall expansible bladder 26 around the upper and lower ends of which steel cuffs 28 and 30 are vulcanized. The upper cuff 28 abuts a collar 32 on pipe 20 and the lower cuff 30 abutts a flange 34 on a nose piece 36. The nose piece consists of a sleeve 38 sealed to the lower end of pipe 20 by an 0 ring 40, sleeve 38 being secured to the lower end of pipe 20 by bolts 41. Across the lower end of sleeve 38 is secured a plate 42 to which a conical nose piece 44 having air slots 46 is welded. Air under pressure is fed into nose piece 44 via a coupling 48 which extends through plate 42 into which is secured an air hose 50 which leads out through an opening in the plate 24 in the top of pipe 20 to a suitable source of compressed air. An air line 52, also connected to a suitable source of compressed air, leads to the space between the double walls of bladder 26.

Figure 4:
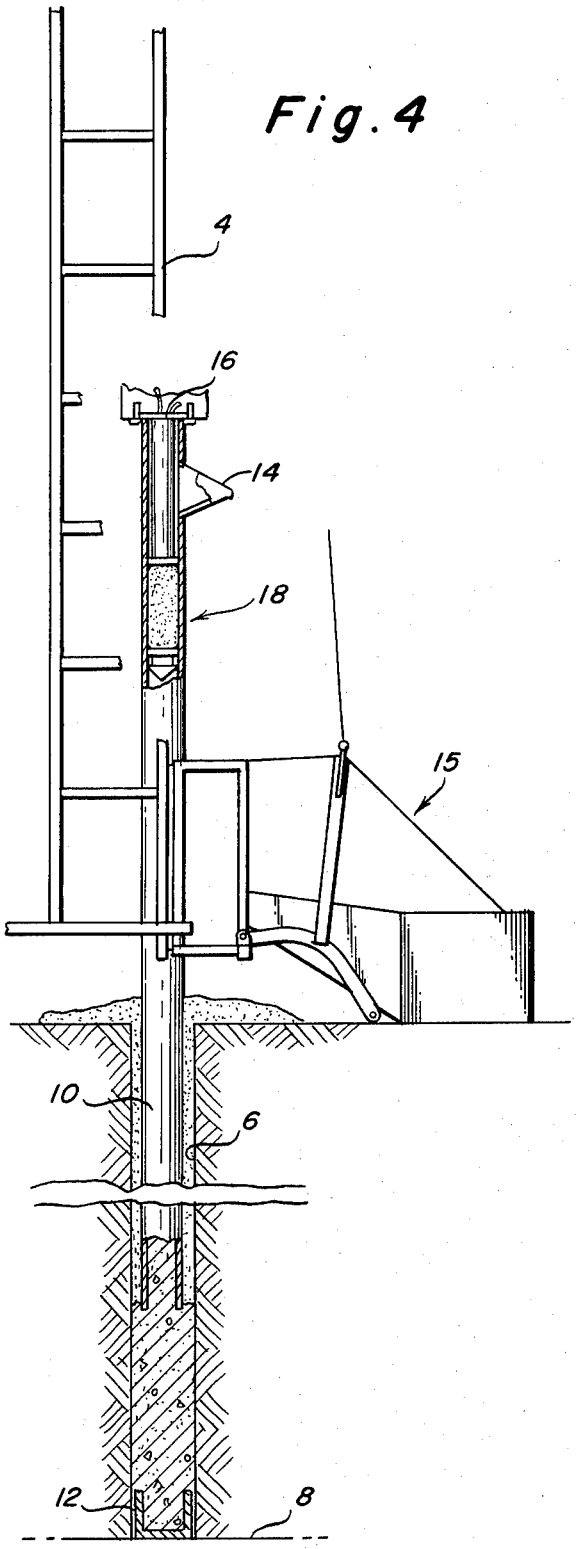
FIG. 4 illustrates the step of forcing air into the mandrel below the chute.
Figure 5:
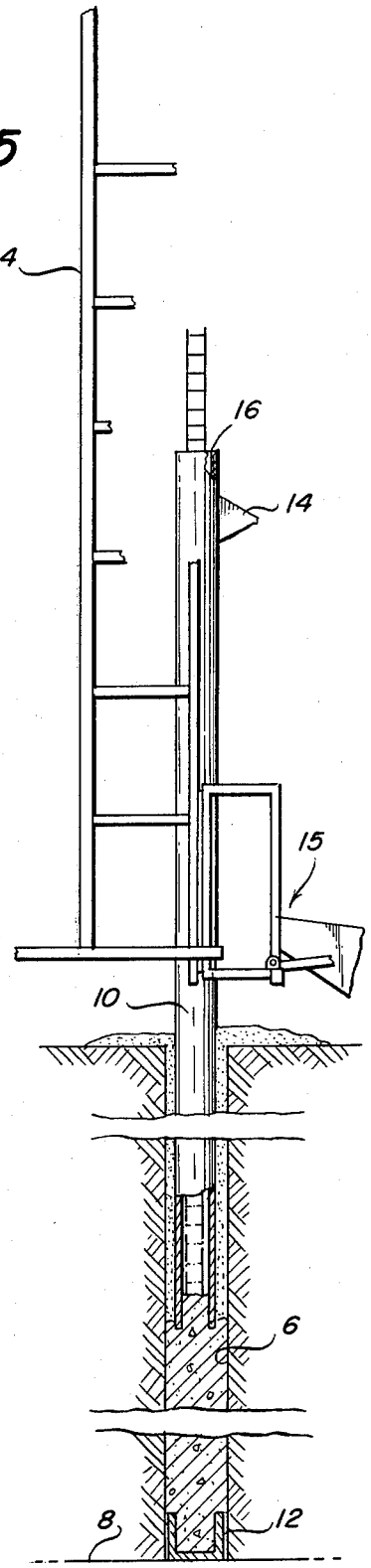
FIG. 5 illustrates the step of inserting re-inforcing steel via the mandrel top of the pile being cast.

In operation, bladder 26 is deflated and the closure is then inserted into the mandrel above the chute opening and the bladder may be then expanded so as to steady the mandrel while concrete is poured into the chute, this being particularly useful when the mandrel has been lifted so that only a relatively short part of its lower end remains in the hole. After a charge of concrete has been poured into the mandrel (FIG. 3) the closure is deflated and lowered into the mandrel until the bladder 26 lies below the concrete chute opening. Then the bladder is inflated so as to seal off the mandrel below the chute opening and compressed air is forced into the mandrel via air hose 50 and slots 46 in conical nose piece 44 while a lifting force is applied to the mandrel via cables extending from the cross trees in the leads to ears 22, thereby lifting the mandrel upwardly in the hole (FIG. 4). This compacts the still fluent concrete, squeezes out voids and forces out the concrete against the sides of the hole. When re-inforcing steel is to be inserted, the closure is lifted away and the re-inforcing steel is inserted into the hole via the open top 16 of the mandrel (FIG. 5). Thereafter, the process is repeated until the hole has been filed with concrete.

I claim:

1. A method for casting piles in situ comprising, pre-drilling a hole in the ground, inserting a hollow mandrel having an open top into the hole, pouring a charge of fluent concrete into the hole via an opening through an upper side wall portion of the mandrel and through the mandrel into the bottom thereof, engaging in the mandrel below the opening an inflatable closure, inflating the closure so as to seal off a portion of the mandrel below the opening, feeding air under pressure via the closure and the mandrel into the sealed off portion of the mandrel until the fluent concrete is forced against the sides of the hole and voids therein are squeezed out while applying a lifting force to the mandrel, deflating the closure and lifting the same to above said opening, and repeating the aforesaid pouring, engaging, inflating, feeding, deflating and lifting steps until the hole is filled with concrete and the mandrel is lifted clear of the hole.

2. In the method recited in claim 1, re-inflating the closure in the mandrel above said opening, and supporting the closure against lateral movement whereby to steady the mandrel while more concrete is poured into the mandrel via the opening.

* * * * *